US008978267B2

(12) United States Patent
Krausch et al.

(10) Patent No.: US 8,978,267 B2
(45) Date of Patent: Mar. 17, 2015

(54) DRYER HAVING A HEAT PUMP, METHOD FOR OPERATING THE SAME, AND METHOD FOR AIR CONDITIONING A ROOM

(75) Inventors: Uwe-Jens Krausch, Brieselang (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1002 days.

(21) Appl. No.: 13/124,909

(22) PCT Filed: Oct. 16, 2009

(86) PCT No.: PCT/EP2009/063543

§ 371 (c)(1),
(2), (4) Date: Apr. 19, 2011

(87) PCT Pub. No.: WO2010/046310

PCT Pub. Date: Apr. 29, 2010

(65) Prior Publication Data

US 2011/0198405 A1 Aug. 18, 2011

(30) Foreign Application Priority Data

Oct. 24, 2008 (DE) ..... 10 2008 043 176

(51) Int. Cl.

| | |
|---|---|
| ***D06F 58/00*** | (2006.01) |
| ***F26B 19/00*** | (2006.01) |
| ***D06F 58/20*** | (2006.01) |
| ***D06F 58/24*** | (2006.01) |
| ***D06F 58/28*** | (2006.01) |

(52) U.S. Cl.

CPC ..... *D06F 58/206* (2013.01); *D06F 58/24* (2013.01); *D06F 58/28* (2013.01)

USPC ..... 34/131; 34/219

(58) Field of Classification Search

USPC ..... 34/579, 77, 78, 131, 132, 219, 524, 34/443; 236/44

See application file for complete search history.

(56) References Cited

U.S. PATENT DOCUMENTS

| | | | | |
|---|---|---|---|---|
| 3,831,294 | A | 8/1974 | Freze | |
| 4,549,362 | A | 10/1985 | Haried | |
| 2005/0086824 | A1 | 4/2005 | Ono et al. | |
| 2009/0100702 | A1 * | 4/2009 | Fair | 34/487 |

FOREIGN PATENT DOCUMENTS

| | | | | |
|---|---|---|---|---|
| CH | 695706 | A5 | 7/2006 | |
| DE | 3000865 | A1 | 7/1981 | |
| DE | 3446468 | A1 | 7/1986 | |
| DE | EP0467188 | A1 * | 1/1992 | D06F 2058/20 |

(Continued)

*Primary Examiner* — Kenneth Rinehart
*Assistant Examiner* — John McCormack
(74) *Attorney, Agent, or Firm* — Nixon & Vanderhye P.C.

(57) ABSTRACT

A dryer is provided that includes a drying chamber for items to be dried; a supply air duct; a process air duct; an exhaust air duct; and a heat pump having a heat sink and a heat source, wherein the supply air duct and the exhaust air duct can be connected to each other through a recirculating air duct by means of a mechanism in order to adjust a proportion of recirculating and exhaust air in the dryer, and wherein the dryer has a first sensor for determining a process air temperature. A method for operating the dryer and a method for controlling the temperature and/or the humidity of the air of a room using the dryer are also provided.

18 Claims, 2 Drawing Sheets

(56) References Cited

FOREIGN PATENT DOCUMENTS

| | | | |
|---|---|---|---|
| DE | 4306217 | A1 | 9/1994 |
| DE | 19731826 | A1 | 2/1998 |
| DE | 19737075 | A1 | 3/1998 |
| DE | 19725536 | A1 | 12/1998 |
| DE | 102007042969 | A1 | 3/2009 |
| EP | 0163265 | B1 | 11/1989 |
| EP | 0467188 | B1 | 4/2001 |
| EP | 1559829 | B1 | 12/2007 |
| EP | 2004901 | B1 | 5/2010 |

* cited by examiner

DRYER HAVING A HEAT PUMP, METHOD FOR OPERATING THE SAME, AND METHOD FOR AIR CONDITIONING A ROOM

BACKGROUND OF THE INVENTION

The invention relates to a dryer with a heat pump, a preferred method for operating the same and a method for air conditioning a room. The method for air conditioning a room especially relates to a method for controlling the temperature and humidity of the air in a room while using this dryer.

In general a tumble dryer is built and operated as a vented-air dryer or condenser dryer. Operation as a vented-air or condensation dryer depends in a number of respects on its installation conditions, especially on the temperature and humidity obtaining in the installation room. Temperature and air humidity in an installation room also influence vented-air and condenser dryers to a different extent.

A condenser dryer, the functioning of which is based on the condensation of the moisture from the laundry evaporated by means of process air in a largely closed circuit, generally does not convey any moisture into an installation room and also makes it possible to recover energy from the heated process air, by using a heat pump for example. The condensate arising in the condenser dryer is collected and either pumped out or disposed of by manually emptying an appropriate collection container.

By contrast, with a vented-air dryer, process air guided in an open circuit and laden with moisture after heating and passage through a laundry drum with the laundry is generally conveyed out of the dryer. There is no heat recovery in this appliance. In addition the air humidity would increase in the installation room; there are therefore numerous regulations stating that the moist process air may not simply be allowed to escape into an installation room, but is removed through a hose or the like from the installation room and the building of which it is part.

DE 30 00 865 A1 discloses a tumble dryer designed as a vented-air dryer with heat recovery. The tumble dryer consists of a container accommodating and agitating the laundry, into which a supply air flow heated by a heating element emerges, while the moist warm air is routed via an outlet as exhaust air. Arranged in the supply air flow in front of the heating element is a heat exchanger through which the moist-warm exhaust air from the container flows.

DE 40 23 000 C2 describes a tumble dryer designed as a condenser dryer with a heat pump in which a supply air opening is arranged in the process air duct between a heat source and a heat sink, represented by condenser and evaporator of the heat pump designed as a compressor heat pump, which is able to be closed off by a controllable closure facility. An exhaust air opening likewise able to be closed off with an assigned closure facility is also present, to enable process air to be removed from the process air duct.

DE 197 37 075 A1 discloses a tumble dryer which is equipped with at least one heat exchanger for heat recovery. Preferably two opposing-flow heat exchangers are used. In a form of embodiment the process air is blown directly into the open air after its passage through the heat exchanger.

DE 197 31 826 A1 describes a tumble dryer with a system for heat return (e.g. a heat pump), in which the largely closed air circuit can exchange the circulating air at two predetermined points through two openings with the air in the room, in order to keep the drying and condensation temperature to the prespecified values.

DE 43 06 217 B4 discloses a programmable tumble dryer with a laundry drum, in which the process air is conveyed through the laundry drum by a fan in a closed process air duct which has closure facilities. The tumble dryer also features a heat pump circuit comprising evaporator, compressor and condenser for removing the moisture in the process air from the laundry drum. The closure facilities are arranged so that the guidance of the process air depends on a process phase.

DE 34 46 468 A1 discloses a method for drying laundry in a tumble dryer with a rotatable laundry drum, a fan, a heater arranged in the flow path of the drying air and also a cooled condenser, via which the drying air is routed after leaving the laundry drum, with the drying air being split up into two part air flows after it leaves the laundry drum. The one part air flow is fed to the condenser and the other bypasses the condenser and is mixed back into the part air flow leaving the condenser.

DE 34 19 743 C2 describes a tumble dryer with a laundry drum, a heater unit provided with a supply air connection and also an exhaust air connection, whereby different supplementary units defining the mode of operation of the tumble dryer are to be arranged for connection between supply air connection of the heater unit and exhaust air connection. In one embodiment of the dryer a recirculation part is connected between the supply air connection flange and the exhaust air flange in which a air control device is located by which the ratio of supply air to exhaust air of the dryer can be varied. This gives the option of a winter-summer switchover. In winter mode cold air is supplied from outside and fed into the dryer. The warm exhaust air of the dryer comes out into the room in which the dryer is sited and contributes to heating up the air in the room.

EP 1 559 829 A describes a laundry drying machine which has devices for directing a partly dehumidified air flow back into the drying air flow. Switchover devices are present which can be set so that the laundry drying machine can be operated simultaneously by means of an open circuit and a closed-circuit, with the relationship between the flow rates in the open circuit and in the closed circuit able to be set and defined.

DE 197 25 536 C2 describes a method for controlling the heating power of a tumble dryer, especially a vented-air tumble dryer, with a drying chamber with an air inlet and an air outlet, with a heating facility arranged before the air inlet and with a program control for controlling the heating facility, with a room air temperature $T_R$, being measured via at least one temperature sensor before the heating facility is put into operation with the process air fan switched on and also at least one further temperature value $T_2$ occurring after a defined period of time before the heating is put into operation. The heating is then activated by a microcomputer as a function of room air temperature value $T_R$ and a relative air humidity $Y_R$ of the room air determined on the basis of this data.

BRIEF SUMMARY OF THE INVENTION

Against this background the object of the present invention is to provide a dryer with a heat pump which makes improved control of its operation possible, with an explicit air conditioning of an installation room able to be possible in forms of embodiment. A corresponding method for operating such a dryer is also to be provided, as well as the method for controlling the temperature and/or the humidity of air of a room in which such a dryer is installed.

This object is achieved according to this invention by a dryer or by one of the said methods with the features of the respective independent claim. Preferred embodiments of the inventive dryer and the inventive method are listed in the respective dependent patent claims, with preferred forms of embodiment of the inventive dryer corresponding to preferred forms of embodiment of the inventive method and also preferred forms of embodiment of the one method corresponding to preferred form of embodiment of the other method and vice versa, even if this is not stated explicitly herein.

The subject matter of the invention is thus a dryer with a drying chamber for items to be dried, a supply air duct, a process air duct, an exhaust air duct and a heat pump with a heat sink and a heat source, with the supply air duct and the exhaust air duct able to be connected to each other through a recirculating air duct by means the mechanism in order to adjust a proportion of recirculating and exhaust air in the dryer and the dryer having a first sensor for determining a process air temperature $T_P$.

Within the meaning of the present description the supply air duct especially extends from its supply air entry up to the heat source of the heat pump and the exhaust air duct especially from an outlet of the drying chamber up to an exhaust air outlet. The process air channel then especially extends from the heat sink of the heat pump to the outlet of the drying chamber.

In addition "connecting supply air duct and outlet air duct to each other", within the meaning of the present description, means that supply air duct and exhaust air duct are at least partly linked to one another.

The dryer features a first sensor for determining a process air temperature $T_P$. This makes it possible to control the mechanism taking into account the thermal conditions in the process air circuit which substantially characterize the operation of the dryer, by measuring and subsequently evaluating a process air temperature in this circuit. This evaluation can take place in a control device belonging to the dryer which can especially contain a programmable logic control, meaning an appropriately programmed microcontroller. It lies within the framework of the invention to place the temperature sensor at a given point in the process air circuit and to derive the definitive statement about the thermal conditions in the process air circuit at points downstream from the sensor if necessary from the use of a theoretical or empirical model especially implemented in the control device.

The term "sensor" as used in this document, means an individual sensor or a system of a number of sensors.

A heat pump here is basically to be understood as any heat pump which is at all suitable for use in a tumble dryer under the relevant conditions in respect of size and operation. In particular the heat pump can be a compressor heat pump which uses cyclically-repeated condensation and evaporation of a coolant for pumping heat between a heat sink and a heat source. Especially conceivable are also heat pumps which in each case use cyclically-repeated absorption or adsorption and desorption of a suitable working medium for such pumping, heat pumps which use a regenerative circulation process of a gas running in a Stirling or Vuilleumier machine and also heat pumps based on the thermoelectric effect.

With a dryer equipped with a heat pump of the present invention the warmed process air laden with moisture is essentially cooled in the heat sink of the heat pump, from where the transmitted heat is pumped in a suitable manner to the heat source of the heat pump. There the pumped heat, if necessary at an increased temperature, is released again and used for heating the process air or the supply air before its entry into the drying chamber.

The inventive dryer generally has a condensate tray for catching the condensate arising in the heat sink or a further heat exchanger. The condensate is disposed off from the condensate tray either by manually emptying it or by pumping it away by means of a condensate pump into a condensate container, which in its turn can be emptied manually, or directly into a waste water system.

The mechanism preferably consists of a mechanical or pneumatic connection between the first controllable closure facility in the supply air duct and a second controllable closure facility in the exhaust air duct. In this case the first controllable closure facility and the second controllable closure facility are preferably arranged in the recirculating air duct. First and second closure facilities can be embodied in any manner provided their controllability is ensured, e.g. they can be present as a valve or a flap. Preferably the first closure facility and/or the second closure facility are embodied as flaps.

The dryer has a first sensor for determining a process air temperature $T_P$. The first sensor is preferably arranged between the drying chamber and the heat sink.

In a further preferred form of embodiment the dryer has a second sensor to determine a temperature $T_R$ and/or a (relative or absolute) humidity $H_R$ of air in an installation room. This makes possible explicit conditioning of the air in the installation room and/or optimum execution of a drying method in the dryer.

A method of operation of the dryer taking account of the conditions in the installation room and in the dryer can be set manually by user of the dryer or automatically. For example, if a process air temperature $T_P$ is too high, a proportion of supply air can be adjusted or increased automatically.

In a form of embodiment the mechanism can only completely connect the supply air duct and the exhaust air duct to each other. In this form of embodiment this means that either supply air duct and exhaust air duct are completely separated from one another so that the recirculating proportion amounts to zero, or supply air duct and exhaust air duct are completely connected to one another so that neither supply air nor exhaust air flows and the recirculated air proportion amounts to 100%.

This form of embodiment is especially advantageous if the ability to allow a user of the dryer to make manual adjustments is to be provided, especially switching over between pure vented-air operation and pure recirculating-air operation. This typically enables a summer and a winter mode to be realized.

In a form of embodiment especially suitable for switching over from summer to winter mode an additional supply air subduct as well as the supply air duct and/or and additional exhaust air subduct as well as the exhaust air duct are disposed in the dryer. This form of embodiment makes it possible, with a high outside temperature, to suck in air from outside via the additional supply air subduct and direct it outwards again via the additional exhaust air subduct. The operation of the heat pump can in this case lead to a cooling of the temperature in the installation room of for example 5 to 8° C. Exhaust air subduct and supply air subduct can be designed as separate pipes or as a pipe-in-pipe system.

In an especially preferred form of embodiment the inventive dryer has first means for comparing a temperature $T_R$ and a humidity $H_R$ of the air in an installation room of the dryer to a process air temperature $T_P$ in the dryer and second means for at least partly opening or closing a first controllable closure facility and a second controllable closure facility as a function of a prespecified temperature difference $\Delta T$ between the temperature $T_P$ and the temperature $T_R$, and/or a prespecified humidity $H_R^{set}$ of the air in the installation room.

The first means and/or the second means preferably comprise a control device of the dryer.

Inventively heat released in the heat source can be used in the supply air duct for heating of supply air or, after connecting supply air duct and exhaust air duct to each other via a recirculating air duct, for heating the recirculated air.

In the inventive dryer a heat pump and an air-air heat exchanger can be used simultaneously.

To heat up the process air a heater, especially an electrical heater, can also be included. If the dryer, in an advantageous form of embodiment, includes an additional heater, faster heating of the process air and thereby more rapid execution of a drying process in the dryer are possible. In addition the dryer can also be used for heating the room air for air conditioning a room. The connection of a heater can thus especially be undertaken as part of the program for winter operation. Such connection is naturally especially simple if the heater is an electrical heater. Use of a heater to be operated with a gaseous or liquid fuel or a heater which obtains heat energy via an appropriate heat exchanger from a source external to the dryer also falls within the scope of the invention.

In a preferred form of embodiment the heater designed as an electrical heater features at least two suitably selected switchable heating stages. Preferably the heater is a two-stage heater with a first switchable heating stage in a first electrical circuit and a second switchable heating stage in a second electrical circuit parallel thereto. Especially preferably the heater is a two-stage heater with a first heating stage in a first electrical circuit and a second heating stage in a second electrical circuit parallel thereto, with a thermoswitch being arranged in the first electrical circuit or in the second electrical circuit which can be suitably switched by a signal of a thermosensor (temperature sensor). The thermosensor can typically be located in the drum, the process air duct or the heat pump circuit. Preferably the thermoswitch switches on reaching or exceeding a predetermined maximum value $T_{max}$ for temperature and opens an electrical circuit in which a heating stage is located. In this form of embodiment the thermoswitch preferably switches on reaching or undershooting a predetermined minimum value $T_{min}$ for a temperature and closes the open circuit.

Preferably the first heating stage has a lower power than the second heating stage, with for example the first heating stage having a power in the range of 200 to 600 W, preferably from 300 to 500 W and the second heating stage having a power in the range of 1000 to 1800 W, preferably in a range of 1200 to 1600 W.

In an alternate form of embodiment the heater has means for continually adjusting the power $P_H$ of the heater.

Preferably an additional supply air subduct as well as the supply air duct and/or an additional exhaust air subduct as well as the exhaust air duct is disposed in the inventive dryer.

Also preferably in the inventive dryer the heat pump is a compressor heat pump and is configured to circulate a coolant, with it having an evaporator as its heat sink, a condenser as its heat source, a compressor and a choke. The coolant circulates in this heat pump, whereby it is driven by the compressor and the compressor thus delivers the energy needed to operate the pump process. The coolant flows at relatively low temperature and relatively low internal pressure to the evaporator, where it evaporates by taking up heat from the process air also flowing through. The evaporated coolant reaches the compressor and is compressed there. From the compressor it reaches the condenser where it is condensed while releasing heat. The heat released reaches the process air again. The liquid coolant flows through a choke, where its internal pressure is reduced, back to the evaporator, by which the circuit is closed. The choke is especially able to be implemented as a valve, diaphragm or capillary. Fluorinated hydrocarbons such as the ethane derivatives R134a and R152a are considered here as coolants, as well as mixtures of fluorinated hydrocarbons such as R407C and R410A and also carbon dioxide and propane.

The subject matter of the invention is also method for operating a dryer with a drying chamber for items to be dried, a supply air duct, a process air duct, an exhaust air duct and a heat pump with a heat sink and a heat source, with the supply air duct and the exhaust air duct able to be connected to each other through a recirculating air duct by means of a mechanism in order to adjust a proportion of recirculating air and exhaust air in the dryer and the dryer having a first sensor for determining a process air temperature $T_P$, and with the supply air duct and the exhaust air duct able to be connected to each other in order to adjust a desired proportion of recirculating air and exhaust air in the dryer to a prespecified extent.

In a preferred form of embodiment of this method the dryer has first means for comparing a temperature $T_R$ and a humidity $H_R$ of the air in an installation room with a temperature $T_P$ and a humidity $H_P$ of the process air in the dryer and second means for at least partly opening or closing a first controllable closure facility and a second controllable closure facility as a function of a predetermined temperature difference $\Delta T$ between the temperature $T_P$ and the temperature $T_R$, and/or a predetermined humidity $H_R^{set}$ of the air in the installation room and the connecting together of supply air duct and exhaust air duct is undertaken as a function of the predetermined temperature difference $\Delta T$ between the temperature $T_P$ and the temperature $T_R$, and/or the predetermined humidity $H_R^{set}$.

It lies within the framework of the invention to embody any necessary sensor systems for measuring the humidity as sensor systems for measuring relative humidity or sensor systems for measuring absolute humidity; if necessary appropriate different sensors can also be used.

The invention also relates to a method for controlling the temperature and/or the humidity of a room using a dryer with a drying chamber for items to be dried, a supply air duct, a process air duct, an exhaust air duct and a heat pump with a heat sink and a heat source, with the supply air duct and the exhaust air duct able to be connected to each other through a recirculating air duct by means of a mechanism in order to adjust a proportion of recirculating air and exhaust air in the dryer and the dryer having a first sensor for determining a process air temperature $T_P$, and with the supply air duct and the exhaust air duct being connected together for controlling an exchange between process air in the dryer and the air in the room to a prespecified extent. This extent will generally range from a complete separation of the supply air duct and exhaust air duct to a complete connecting together of the supply air duct and exhaust air duct.

It lies within the framework of the invention to execute any necessary measurements of the humidity as measurements of relative humidity or absolute humility; the choice between these alternatives is made in such cases primarily by the choice of the sensor systems used.

In a preferred form of embodiment of the method for controlling the temperature and/or the humidity of air of a room, the sensor has first means for comparing a temperature $T_R$ and a humidity $H_R$ of the air in an installation room to a temperature $T_P$ and a humidity $H_P$ of the process air in the dryer and second means for at least partly opening or closing a first controllable closure facility and a second controllable closure facility as a function of a predetermined temperature difference $\Delta T$ between the temperature $T_P$ and the temperature $T_R$, and/or a predetermined humidity $H_P^{set}$ of the air in the installation room, and the supply air duct and exhaust air duct are connected together as a function of the predetermined temperature difference $\Delta T$ between the temperature $T_P$ and the temperature $T_R$, and/or the predetermined humidity $H_R^{set}$.

The first means preferably include a control device as well as the first sensor and second sensor described above.

Inventively it is preferred for exhaust air, supply air, recirculating air and/or, if present, coolant, to each be routed in a crossflow or opposing-flow process through the corresponding heat exchanger.

The inventive dryer has the advantage of making possible an energy-efficient and secure execution of the drying method, with different installation conditions and different weather conditions and seasons able to be taken into account in the optimum manner. In addition the invention makes it possible to use a dryer for air conditioning a room.

BRIEF DESCRIPTION OF THE DRAWINGS

Further details of the invention emerge from the description given below of non-restrictive exemplary embodiments for a dryer and for a method employing this dryer. These embodiments refer to FIGS. 1 and 2.

DETAILED DESCRIPTION OF EXEMPLARY EMBODIMENTS OF THE PRESENT INVENTION

Figure 1:
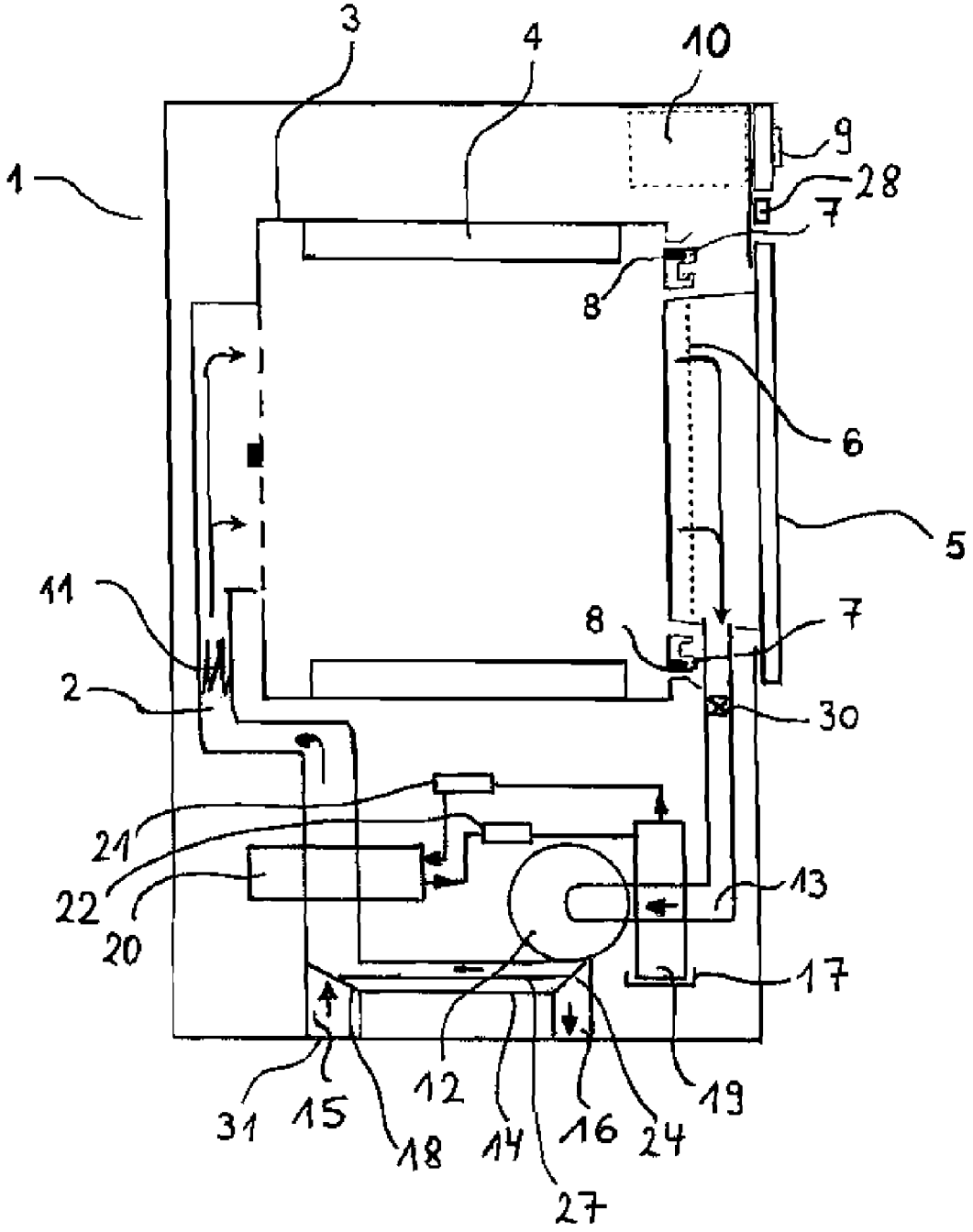
FIG. 1 shows a vertical section through a dryer in accordance with the first form of embodiment in which the mechanism for connecting together supply air duct and exhaust air duct consists of a mechanical combination of two flaps as controllable closure facilities.

The dryer 1 shown in FIG. 1 has a drum able to be rotated around a horizontal axis as its drying chamber 3, within which agitators 4 for moving laundry during a drum rotation are attached. Process air is guided by means of a fan 12 via an electric heater 11 through the drum 3 in a process air duct 2. From a supply air entry 31, air from the room is fed via a supply air duct 15 into the process air duct 2 or is sucked in by the fan 12. After its passage through the drum 3, the moist, warm process air is conveyed into the evaporator 19 which forms the heat sink 19 of a heat pump 19, 20, 21, 22. The cooled process air can be routed in the exhaust air duct 13 via the exhaust air outlet 16 into the room air. The arrows shown in FIG. 1 specify the direction of flow of the air.

The coolant of the heat pump 19, 20, 21, 22 evaporated in the evaporator 19 is routed via a compressor 21 to the condenser 20, which is the heat source 20 in the heat pump 19, 20, 21, 22. In the condenser 20 the coolant condenses while giving off heat to the process air flowing in the supply air duct 15 or process air duct 2. The coolant, now present in liquid form, is directed via a choke 22 back to the evaporator 19 through which the coolant circuit is closed.

In the form of embodiment shown in FIG. 1 the supply air duct 15 and the exhaust air duct 13 can be connected to each other via a mechanism 18, 24, 27. In this case flaps 18 and 24 can be adjusted as controllable closure facilities so that they can fully open or block the exhaust air duct 13 in the direction of the exhaust air outlet 16 and the supply air duct 15 in the direction of the supply air entry 31 or these can be partly opened.

In the form of embodiment shown in FIG. 1 the flaps 18 and 24 act in the same way. In this case either both flaps 18 and 24 are completely closed, completely opened or partly opened. FIG. 1 depicts a state in which the flaps 18 and 24 are set so that exhaust air duct 13 and supply air duct 15 are connected to each other via a recirculating air duct 14. In this state the dryer of the first form of embodiment operates in accordance with the recirculating air principle.

The mechanism in the form of embodiment depicted in FIG. 1 includes a mechanical facility 27 which brings about a simultaneous adjustment of the flaps 18 and 24.

A first sensor 30 accommodated within the dryer 1 is used to measuring the temperature of the process air in the exhaust air duct. A second sensor 28 accommodated externally on the dryer 1 is used for measuring the temperature and/or the relative humidity of the air in the installation room of the dryer.

In the dryer of FIG. 1 air heated by the heater 11 is conveyed from the rear, i.e. from the side of the drum 3 lying opposite a door 5 through its perforated base into the drum 3, comes into contact there with the laundry to be dried and flows through the fill opening of the drum 3 to a lint filter 6 within a door 5 closing off the fill opening. Subsequently the process air flow is diverted downwards in the door 5. The process air is guided in an exhaust air duct 13 to the evaporator 19, in which the warm process air laden with moisture is cooled off and subsequently is guided to an exhaust air outlet 16 or a recirculating air duct 14. The separated moisture is caught in a condensate trapping container 17 from where it can be removed, for example by pumping it away.

Figure 2:
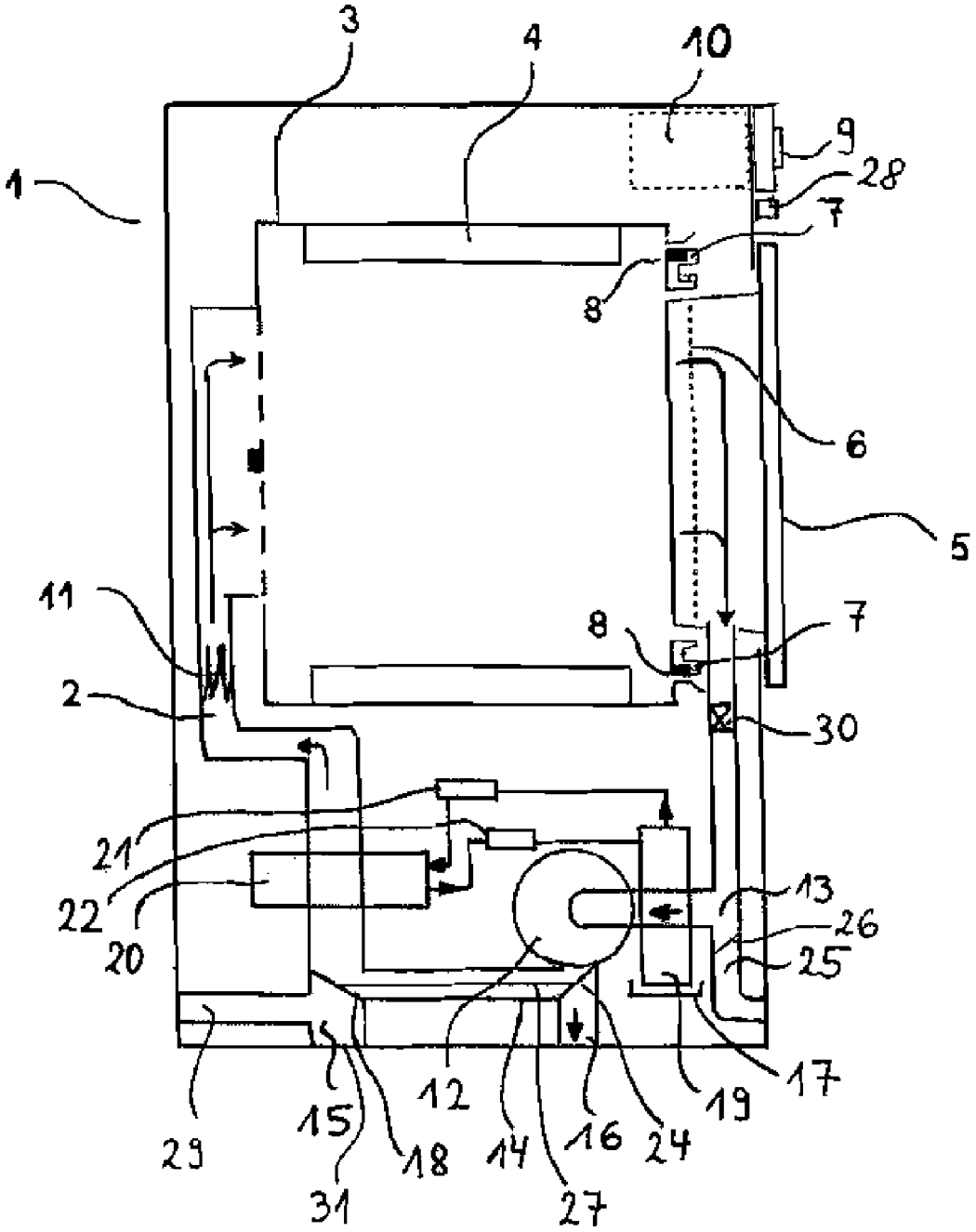
FIG. 2 shows a vertical section through a dryer in accordance with the second form of embodiment in which the mechanism for connecting together supply air duct and exhaust air duct consists of a mechanical combination of two flaps as controllable closure facilities and in addition to the supply air duct, a supply air subduct and in addition to the exhaust air duct, an exhaust air subduct are present.

The drum 3 is supported in the form of embodiment depicted in FIG. 1 and FIG. 2 at the rear base by means of a rotary bush and at the front by means of a support plate 7, with the drum 3 resting with a rim on a sliding strip 8 on the end shield 7 and is held in this way at its front end. The condensation dryer is controlled by a control device 10 which can be regulated by the user via a control unit 9. On the control unit (not shown in greater detail here) a switch can be made between vented-air mode and recirculating air mode.

The second form of embodiment depicted in FIG. 2 differs from the first form of embodiment depicted in FIG. 1 in that an additional supply air subduct 29 is present as well as the supply air duct 15 and an additional exhaust air subduct 25 is present as well as the exhaust air duct 13. The supply air duct 15 is connected to the installation room while the supply air subduct 29 is connected to the air outside the installation room (e.g. the outside air outside a building). The exhaust air duct 13 is connected to the installation room while the exhaust air subduct 25 is connected to the air outside the installation room (e.g. the outside air outside a building).

A part of the warm process air laden with moisture exiting from the drying chamber 3 can be split off in the second form of embodiment via the exhaust air subduct 25 located before the entry into the evaporator 19 and conveyed into the installation room of the dryer. The proportion of this air can be controlled by a third regulatable closure facility 26 (for example a flap). In this case a balance between the air exhausted into the installation room should be ensured by letting in a corresponding amount of supply air via the supply air duct 15 and/or the supply air subduct 29.

The dryers 1 in accordance with both forms of embodiment are thus intended and suitable for operation for the purposes of drying items to be dried inserted into the drying chamber 3, especially items of laundry, with the supply air duct and the exhaust air duct being connected together in order to adjust a desired proportion of recirculating air and exhaust air in the dryer 1 to a prespecified extent.

Each of these dryers 1 is also suitable and specified for a method for controlling the temperature and/or the humidity of air of the room in which it is installed, with the supply air duct 15 and the exhaust air duct 13 being connected to each other to control an exchange between process air in the dryer 1 and the air of the room to a prespecified extent.

In particular with each of these dryers 1, first means 10, 28, 30 can be provided for comparing a temperature $T_R$ and a humidity $H_R$ of the air in an installation room with a temperature $T_P$ and a humidity $H_P$ of the process air in the dryer 1 and second means 10, 18, 24 for at least partly opening or closing a first controllable closure facility 18 and a second controllable closure facility 24 as a function of a prespecified temperature difference $\Delta T$ between the temperature $T_P$ and the temperature $T_R$, and/or a prespecified humidity the $H_R^{set}$ of the air in the installation room, with the connecting together of supply air duct 15 and exhaust air duct being undertaken as a function of the prespecified temperature difference $\Delta T$ between the temperature $T_P$ and the temperature $T_R$, and/or the prespecified humidity $H_R^{set}$.

The invention claimed is:

1. A dryer, comprising:

a drying chamber for items to be dried;

a supply air duct;

a process air duct;

an exhaust air duct;

a heat pump with a heat sink and a heat source;

a recirculating air duct to connect the supply air duct and the exhaust air duct by a mechanism in order to adjust a proportion of recirculating air and exhaust air in the dryer;

a first sensor to determine a process air temperature;

a controller to control the mechanism as a function of measured values of the first sensor;

a comparator to compare an installation room temperature and an installation room humidity of air in an installation room to the process air temperature and a process air humidity of the process air in the dryer; and an assembly to at least partly open or close a first controllable closure facility and a second controllable closure facility of the mechanism as a function of at least one of a prespecified temperature difference between the process air temperature and the installation room temperature and a prespecified humidity of the air in the installation room.

2. The dryer of claim 1, wherein the mechanism includes one of a mechanical connection and a pneumatic connection between the first controllable closure facility in the supply air duct and the second controllable closure facility in the exhaust air duct.

3. The dryer of claim 2, wherein the first controllable closure facility and the second controllable closure facility are arranged in the recirculating air duct.

4. The dryer of claim 2, wherein the first controllable closure facility and the second controllable closure facility are embodied as flaps.

5. The dryer of claim 1, wherein the first sensor is arranged between the drying chamber and the heat sink.

6. The dryer of claim 1, further comprising a second sensor to determine at least one of the installation room temperature and the installation room humidity of the air in the installation room.

7. The dryer of claim 1, wherein the mechanism only completely connects the supply air duct and the exhaust air duct to each other.

8. The dryer of claim 1, further comprising a heater.

9. The dryer of claim 1, further comprising at least one of a supply air subduct and an exhaust air subduct.

10. The dryer of claim 1, wherein the heat pump is a compressor heat pump; wherein the heat pump circulates a coolant; wherein the heat sink of the heat pump is an evaporator, wherein the heat source of the heat pump is a condenser, and wherein the heat pump has a compressor and a choke.

11. A method for operating a dryer having a drying chamber for items to be dried, a supply air duct, a process air duct, and an exhaust air duct and a heat pump with a heat sink and a heat source, the method comprising:

connecting the supply air duct and the exhaust air duct to each other via a recirculating air duct by a mechanism in order to adjust a proportion of recirculating air and exhaust air in the dryer;

determining a process air temperature with a first sensor;

controlling the mechanism with a controller as a function of measured values of the first sensor;

connecting the supply air duct and the exhaust air duct to each other to a prespecified extent in the dryer in order to adjust a desired proportion of the recirculating air and the exhaust air;

comparing, with a comparator in the dryer, an installation room temperature and an installation room humidity of air in an installation room with the process air temperature and a process air humidity of process air in the dryer; and at least partly opening or closing a first controllable closure facility and a second controllable closure facility with an assembly, as a function of at least one of a prespecified temperature difference between the process air temperature and the installation room temperature and a prespecified humidity of the air in the installation room;

wherein the connection of the supply air duct and the exhaust air duct to each other is undertaken as a function of at least one of the prespecified temperature difference between the process air temperature and the installation room temperature and the prespecified humidity of the air in the installation room.

12. A method for controlling at least one of a temperature and humidity of air of a room in which a dryer is located, the dryer having a drying chamber for items to be dried, a supply air duct, a process air duct, an exhaust air duct and a heat pump with a heat sink and a heat source, the method comprising:

connecting the supply air duct and the exhaust air duct to each other via a recirculating air duct by a mechanism in order to adjust a proportion of recirculating air and exhaust air in the dryer;

determining a process air temperature with a sensor;

controlling the mechanism with a controller as a function of measured values of the first sensor;

connecting the supply air duct and the exhaust air duct to each other to a prespecified extent in the dryer in order to adjust a desired proportion of the recirculating air and the exhaust air;

comparing, with a comparator in the dryer, an installation room temperature and an installation room humidity of air in an installation room with the process air temperature and a process air humidity of process air in the dryer; and at least partly opening or closing a first controllable closure facility and a second controllable closure facility with an assembly, as a function of at least one of a prespecified temperature difference between the process air temperature and the installation room temperature and a prespecified humidity of the air in the installation room;

wherein the supply air duct and the exhaust air duct are connected to each other as a function of at least one of the prespecified temperature difference between the process air temperature and the installation room temperature and the prespecified humidity of the air in the installation room.

13. The method of claim 11, further comprising determining at least one of the installation room temperature and the installation room humidity of the air in the installation room by way of a second sensor.

14. The method of claim 13, wherein the mechanism only completely connects the supply air duct and the exhaust air duct to each other.

15. The method of claim 14, wherein the heat pump circulates a coolant.

16. The method of claim 12, further comprising determining at least one of the installation room temperature and the installation room humidity of the air in the installation room by way of a second sensor.

17. The method of claim 16, wherein the mechanism only completely connects the supply air duct and the exhaust air duct to each other.

18. The method of claim 17, wherein the heat pump circulates a coolant.

* * * * *